United States Patent [19]

Kimura

[11] 4,196,034

[45] Apr. 1, 1980

[54] METHOD OF MAKING A POUCH USABLE AS A CUP

[76] Inventor: Kinichi Kimura, 21-11, 3-chome, Akatsukashinmachi, Itabashi-ku, Tokyo, Japan

[21] Appl. No.: 773,665

[22] Filed: Mar. 2, 1977

[30] Foreign Application Priority Data

May 13, 1976 [JP] Japan ..... 51-54530

[51] Int. Cl.[2] ..... B31B 21/00; B65D 33/18; B32B 31/04

[52] U.S. Cl. ..... 156/204; 156/211; 156/217; 156/226; 156/289; 229/55; 206/629

[58] Field of Search ..... 156/226, 227, 289, 211, 156/217, 204; 229/55, 14 B, 14 BA, 14 BW; 206/620, 625, 629, 634

[56] References Cited

U.S. PATENT DOCUMENTS

| | | | |
|---|---|---|---|
| 2,234,065 | 3/1941 | Vogt | 229/55 |
| 2,409,998 | 10/1946 | Waters | 229/55 |
| 2,695,129 | 11/1954 | Stahmer | 229/55 |
| 3,554,434 | 1/1971 | Anderson | 229/55 |
| 3,570,375 | 3/1971 | Williams et al. | 156/289 |
| 3,684,156 | 8/1972 | Fettinger et al. | 206/629 |
| 3,749,593 | 7/1973 | Keiser | 156/289 |

*Primary Examiner*—John T. Goolkasian
*Assistant Examiner*—William H. Thrower
*Attorney, Agent, or Firm*—Frishauf, Holtz, Goodman & Woodward

[57] ABSTRACT

A pouch usable as a cup comprising a rigid outer sheet and a flexible inner sheet laminated on the inner surface of the outer sheet which are folded to form a pouch. The bottom of the inner sheet is not adhered to the bottom of the outer sheet whereby the outer sheet is deformed by pressing the side edges thereof to expand the bottom of the inner sheet to form a cup.

20 Claims, 6 Drawing Figures

METHOD OF MAKING A POUCH USABLE AS A CUP

BACKGROUND OF THE INVENTION

This invention relates to a method of producing a pouch usable as a cup, which has fillings sealed therein and which is cut off at the top to provide an opening of the resultant cup.

Recently, a pouch made of a synthetic resin film, which is capable of standing firmly on a flat plane with food or the like housed therein, has come to be used widely. Such a pouch, however, must be able to stand by itself with food, etc., housed therein. To be more specific, a pouch of this type quite differs from the one intended to act as a cup when a liquid such as water has been poured thereinto from an opening provided by cutting off the upper end portion thereof.

The known pouch has the side wall and the bottom thereof made of the same material or materials similar to each other. Thus, if made of a soft, flexible material, the side wall of the pouch is too soft to enable the pouch to serve as a cup, i.e. a structure capable of standing by itself when water, etc. has been poured thereinto. In addition, the bottom of the pouch is prepared by inwardly folding the lower end portion of the material sheet, resulting in that the bottom is a double wall structure. It follows that a powdered fruit juice or the like sealed in the pouch enters the clearance between the superposed sheets at the bottom. This presents a difficulty that, when a liquid like water has been poured into the pouch, good mixing can not be achieved between the powder and the liquid.

SUMMARY OF THE INVENTION

An object of this invention is to provide a pouch having the bottom of a single wall structure and capable of readily spreading into the shape of a cup, and to provide a method of producing such a pouch usable as a cup.

According to the present invention, a method of producing a pouch usable as a cup comprises providing an opening at the central portion of a flat outer sheet having a reasonable rigidity and flexibility, and bonding an inner sheet of greater flexibility than the outer sheet to a major portion of the inner face of the outer sheet, the bonding being not effective over a given area around the opening of the outer sheet. The bonded sheets are then folded at the center and on a line extending through the opening so that the folded halves of the bonded sheets are folded toward each other. Then the periphery of the folded bonded sheets is bonded together except at the bottom portion of the resulting pouch at which portion the inner sheet is not bonded to the outer sheet.

In a preferred arrangement, the opening is a long slender slit and the inner sheet is not bonded to the outer sheet over a substantially elliptical portion with the slit serving as the major axis of the ellipse. In a still further preferred arrangement, slits are provided at other portions of the outer sheet, which slits are in registration when the sheets are folded, the additional slits being at the top of the resulting pouch so as to serve as a cutting portion for the resulting pouch.

DETAILED DESCRIPTION OF PREFERRED EMBODIMENTS

There will now be described one embodiment of the present invention with reference to the drawings.

Figure 1:
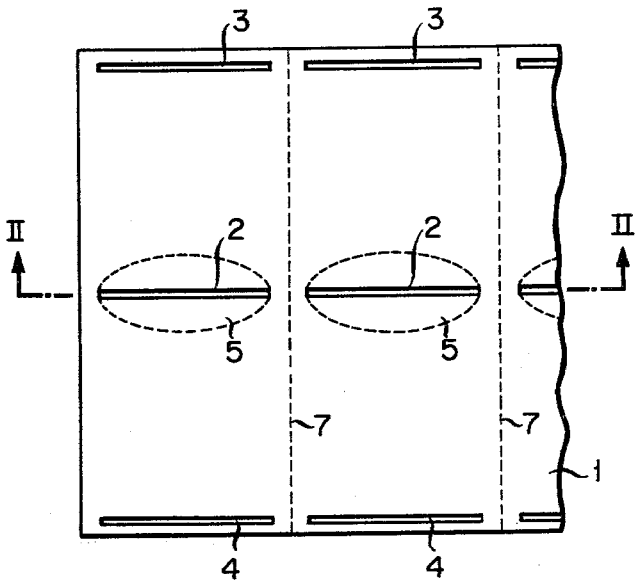
FIG. 1 is a plan view showing a part of the outer sheet of a pouch according to one embodiment of this invention.

As shown in FIG. 1, an outer sheet 1 having a reasonable rigidity, made of, for example thick paper is provided with a number of long central slits 2 equidistantly formed along the central line of the sheet 1. Other slits 3 and 4 are also formed at the upper and lower end portions of the outer sheet, respectively. These slits 2, 3 and 4 may be equal to each other in length. In addition, when the outer sheet has been folded along the central line, the slits 3 and 4 are overlapped with each other.

Figure 2:
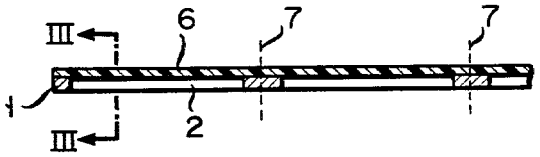
FIG. 2 is a cross sectional view along the line II—II of FIG. 1, showing a state in which an inner sheet is bonded to the outer sheet.

The inner face of the outer sheet 1 is partially coated with silicone 5, the coated portion being in the form of an ellipse with the slit 2 providing the major axis as shown in FIG. 1. An inner sheet 6 (FIG. 2) made of thermoplastic synthetic resin, for example, polyethylene is thermally fused to the inner face of the outer sheet 1 so as to provide a laminate. In this case, the inner sheet 6 is not bonded to the silicone-coated portion of the outer sheet.

Figure 3:
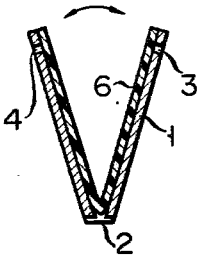
FIG. 3 is a cross sectional view showing a state in which the bonded sheets cut off along a broken line 7 of FIG. 1 are partly folded and observed in the direction of arrows III of FIG. 2.
Figure 4:
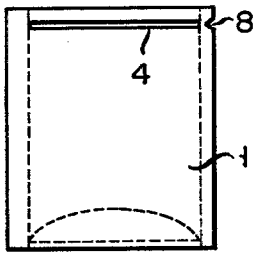
FIG. 4 is a front view of the resultant pouch.

The laminate is cut off along dotted lines 7, 7 to be divided into a plurality of small laminated members. Each small laminated member is folded along the central line, i.e. along the slit 2, in a manner that the inner sheet 6 is positioned inside as shown in FIG. 3. Naturally, the folded portions are entirely overlapped and, thus, overlapping takes place between the slits 3 and 4. The folded laminate is then thermally fused at opposite side edges, the fused portion reaching the ends of the slits 2, 3 and 4. As readily seen from FIG. 4, the thermal fusion results in a bag of the laminate having an opening at the upper edge. The bag thus prepared is loaded with food such as powdered fruit juice or powdered coffee, followed by sealing the upper opening by thermal fusion. Finally, a cutting portion 8 is formed at the upper end portion to extend near the end of the overlapped slits 3, 4. Apparently, the cutting portion 8 and the overlapped slits 3, 4 are intended to facilitate the cutting of the upper end portion of the pouch.

Figure 5:
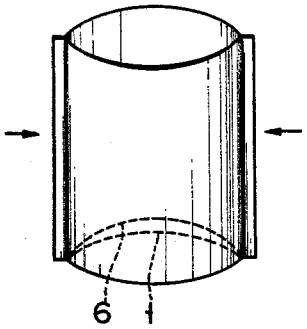
FIG. 5 is an oblique view showing the pouch of FIG. 4 used as a cup.

When it is intended to prepare a drink using the powdered material sealed in the pouch, the upper end portion of the pouch is cut away first from the cutting portion 8 so as to provide an upper opening (or inlet). In this case, the overlapped slits 3 and 4 serve to provide a neat cutting of the upper end portion of the pouch, along a straight line. When pressed by fingers in the direction as shown by arrows in FIG. 5, the pouch having the upper opening is turned into a cup capable of standing firm on a flat plane even when filled with cold water or hot water for preparing a desired drink.

The thermally fused opposite side edge portions of the cup are about twice as thick as the circumferential wall of the cup, because the edge portions mentioned are prepared by thermally fusing the double-folded laminate of the inner and outer sheets. Naturally, the edge portions are more rigid than the circumferential wall. This rigidity facilitates the turning of the pouch into a cup when pressed by fingers. In addition, the edge portions act as a grip of the resultant cup. What is of high importance in this invention is that the bottom of the resultant cup is constituted by the inner sheet 6 alone. As described previously, the outer sheet 1 is provided with the central slit 2 and is coated with silicone 5 around the slit 2. Because of the provision of the slit 2, the rigid outer sheet constitutes the circumferential wall portion alone of the resultant cup. In addition, the flexible inner sheet is not bonded to the outer sheet at the silicone-coated portion as described previously.

It follows that the bottom of the cup is constituted by the flexible inner sheet alone. Naturally, the bottom is of a single wall structure and capable of readily spreading outward.

As described in detail, the pouch according to this invention is usable as a cup. No difficulty is involved in expanding the pouch into the shape of a cup. In addition, the resultant cup is capable of standing firmly on a flat plane because the rigid outer sheet provides the periphery of the bottom of the cup. An additional merit to be noted is that the fused portions of the laminated outer and inner sheets perform a heat insulating function particularly when hot water is poured into the cup, rendering it easier to hold the cup at the grip provided by the fused portions. Of course, the process of producing the pouch is very simple and, thus, suitable for a large scale production of the pouches.

In the embodiment described, a thick paper and a thin synthetic resin sheet or film were used as the outer sheet and the inner sheet, respectively. But, the materials of the sheets need not be restricted to those mentioned, provided that the inner sheet should be relatively flexible and the outer sheet should have a reasonable rigidity. The silicone used for preventing the bonding of the inner and outer sheets can also be replaced by another suitable substance depending on the materials actually used as the inner and outer sheets. In the embodiment described, the silicone was coated on the outer sheet in an elliptical shape. But, a substance for preventing the bonding of the sheets may be coated in another shape, for example, in a rectangular shape on the inner sheet, not on the outer sheet. Further, such a substance is not necessarily coated if the inner sheet and the outer sheet are selectively fused thermally so as to leave a desired portion unfused.

Figure 6:
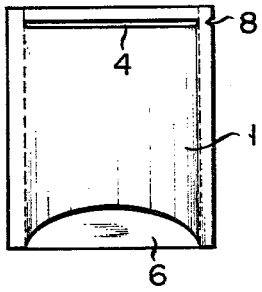
FIG. 6 is a front view of a pouch according to another embodiment of this invention.

FIG. 6 shows another embodiment of this invention. The pouch shown in FIG. 6 differs from the one previously described simply in that an outer sheet is provided with an elliptical opening at the center in contrast to the central slit 2. The pouch of this type is slightly inferior to the one previously described in the capability of standing firmly on a flat plane, but is fully satisfactory in actual use. It is seen that the lower end of the outer sheet 1 presents a semicircular curve in the folded state of the pouch. When expanded to provide a cup, the lower ends of the fused portions alone are brought in direct contact with a flat plane. Needless to say, it is unnecessary to use a substance for preventing the bonding of the inner and outer sheets in the embodiment of FIG. 6.

What is claimed is:

1. A method of producing a pouch usable as a cup, comprising:

providing an opening at the central portion of a flat outer sheet having a reasonable rigidity and flexibility, said opening being interior of the edges of said outer sheet;

then bonding the major portion of an inner sheet of greater flexibility than said outer sheet to a major portion of the inner face of said outer sheet, said bonding being not effected only over a minor portion of said inner sheet which consists of a given area around said previously provided opening of said outer sheet;

then folding said bonded sheets at the center and on a line extending through said opening so that the folded halves of said bonded sheets are folded toward each other with said inner sheet interior of said outer sheet; and then bonding together the periphery of the folded bonded sheets except at the bottom portion of the resultant pouch to define an unbonded bottom portion in the vicinity of the edges of said outer sheet which define said previously provided opening, such that at said unbonded bottom portion said inner sheet is not bonded to said outer sheet and only the minor portion of said inner sheet not bonded to said outer sheet constitutes the bottom of the resultant pouch.

2. The method of claim 1 wherein said opening provided at the central portion of said outer sheet is a long, slender slit, and wherein said given area over which said inner sheet is not bonded to said outer sheet is a substantially elliptical area with the slit providing the major axis of the ellipse.

3. The method of claim 1 wherein said opening provided at the central portion of said outer sheet is a substantially elliptical opening and said inner sheet corresponding to said elliptical opening provides the bottom of the resultant cup.

4. The method of claim 1 comprising providing elongated slits in said flat outer sheet on opposite sides of said opening and located symmetrically on opposite sides of the line on which said bonded sheets are folded toward each other, said elongated slits being located such that they overlap each other when said bonded sheets are folded, said elongated slits being located at the top of and interiorly of the resulting pouch relative to the bonded periphery thereof.

5. The method of claim 4 further comprising forming a notch in said bonded sheets adjacent said overlapped elongated slits.

6. The method of claim 1 wherein said bonding step comprises thermally fusing the peripheral edges of the folded bonded sheets except at said bottom portion thereof.

7. The method of claim 1 comprising treating the region around said opening at the central portion of said outer sheet so as to prevent said inner sheet from being bonded to said outer sheet over a given area around said opening of said outer sheet.

8. The method of claim 7 wherein said treating step comprises coating silicone on at least one of said inner sheet and outer sheet to prevent bonding together thereof over said given area around said opening of said outer sheet.

9. The method of claim 1 wherein said inner sheet comprises a liquid proof sheet.

10. The method of claim 1 wherein said outer sheet comprises a thick paper sheet.

11. The method of claim 1 wherein said opening at said central portion of said outer sheet is symmetrically formed relative to the center line thereof so that the bottom edges of the resulting cup, formed by the edges of said outer sheet adjacent the fold line, form an outer circular edge when said pouch is expanded to the form of a cup.

12. A method of producing a plurality of pouches usable as respective cups, comprising:

providing a plurality of spaced openings in a flat outer sheet having a reasonable rigidity and flexibility, said openings being interior of the edges of said outer sheet;

then bonding the major portion of an inner sheet of greater flexibility than said outer sheet to a major portion of the inner face of said outer sheet, said bonding being not effected only over a minor portion of said inner sheet which consists of given areas around said respective openings of said outer sheet;

folding said bonded sheets on a line extending through said openings so that the folded halves of said bonded sheets are folded toward each other with said inner sheet interior of said outer sheet;

bonding together the peripheral portions of the folded bonded sheets except at the bottom portions of the resulting pouches to define unbonded portions in the vicinity of the edges of said outer sheet which define said previously provided openings, such that at said unbonded portions said inner sheet is not bonded to said outer sheet and only the minor portions of said inner sheet not bonded to said outer sheet constitute the bottoms of the resultant pouches, portions of said bonded sheets being bonded together between adjacent ones of said spaced openings; and separating said resulting pouches along a line between said adjacent openings to form a plurality of pouches.

13. The method of claim 12 comprising separating said pouches along a line extending through said bonded portions which are located between said adjacent openings.

14. The method of claim 12, wherein said openings provided in said outer sheet are long, slender slits, and wherein said given areas over which said inner sheet is not bonded to said outer sheet are substantially elliptical areas with the respective slits providing the major axis of the respective ellipses.

15. The method of claim 12, further comprising providing elongated slits in said flat outer sheet on opposite sides of said respective openings and located symmetrically on opposite sides of the line on which said bonded sheets are folded toward each other, said elongated slits being located such that the respective slits on opposite sides of said fold line overlap each other when said bonded sheets are folded, said elongated slits being located at the top of and interiorly of the resulting pouch relative to the bonded peripheries thereof.

16. The method of claim 12 comprising treating the region around said openings of said outer sheet so as to prevent said inner sheet from being bonded to said outer sheet over respective given areas around said openings of said outer sheet.

17. The method of claim 16 wherein said treating step comprises coating silicone on at least one of said inner sheet and outer sheet to prevent bonding together thereof over said given areas around said openings of said outer sheet.

18. The method of claim 12 wherein said inner sheet comprises a liquid proof sheet.

19. The method of claim 12 wherein said outer sheet comprises a thick paper sheet.

20. The method of claim 12 wherein said bonding step comprises thermal fusion.

* * * * *